United States Patent [19]

Müller

[11] Patent Number: 4,849,675

[45] Date of Patent: Jul. 18, 1989

[54] INDUCTIVELY EXCITED ION SOURCE

[75] Inventor: Jürgen Müller, Frankfurt, Fed. Rep. of Germany

[73] Assignee: Leybold AG, Fed. Rep. of Germany

[21] Appl. No.: 79,649

[22] Filed: Jul. 30, 1987

[30] Foreign Application Priority Data

Sep. 24, 1986 [DE] Fed. Rep. of Germany ..... 3632340

[51] Int. Cl.[4] ..... H05H 1/46; H01T 23/00; H01F 15/18

[52] U.S. Cl. ..... 315/111.51; 315/111.81; 313/230; 313/231.31; 313/359.1

[58] Field of Search ..... 315/111.51, 111.81, 315/39; 219/121 PR, 121 PM; 313/359.1, 362.1, 230, 231.31

[56] References Cited

U.S. PATENT DOCUMENTS 3,084,281 4/1963 Mills ..... 315/111.51

FOREIGN PATENT DOCUMENTS 0169744 1/1986 European Pat. Off. ..... 315/111.51
2112888 3/1973 Fed. Rep. of Germany ..... 315/111.51
2245753 4/1973 Fed. Rep. of Germany ..... 315/111.51
2544275 9/1975 Fed. Rep. of Germany ..... 315/111.51
2531812 2/1976 Fed. Rep. of Germany ..... 315/111.51

OTHER PUBLICATIONS

"Electron Cyclontron Wave Resonances . . . Static Magnetic Field", Plasma Physics, vol. 16, pp. 835–844, Pergamon Press, 1974.

"The RF-ION Source Rig 10 for Intense Hydrogen Ion Beams", Journal De Physique, Collogue C7, Supp. No. 7, vol. 40, Jul. 1979, C7-477–478.

"Electron Cyclotron Resonances in a Radio Frequency Ion Source", Nuclear Instruments & Methods 16, (1962), 227–232.

*Primary Examiner*—Edward L. Coles, Sr.
*Assistant Examiner*—Mark R. Powell
*Attorney, Agent, or Firm*—Steele, Gould & Fried

[57] ABSTRACT

The invention relates to an inductively excited ion source with a vessel (1) around which a coil (2) is wound. The vessel (1) consists of a chemically inert material and is used to receive the substance to be ionized. A high-frequency generator (12) is connected by one of its terminals to the coil (2) both ends of which are grounded, while the other terminal (22) is also grounded. The length of the coil (2) which is to be regarded as an electrically long conductor, is $\lambda/2$, $\lambda$ being the wavelength of the voltage of the high-frequency generator (12) (FIG. 3).

15 Claims, 4 Drawing Sheets

INDUCTIVELY EXCITED ION SOURCE

The invention relates to an inductively excited ion source with a vessel for receiving substances to be ionized, in particular gases, the substances to be ionized being surrounded by a waveguide which is connected to a high-frequency generator, with the two ends of the waveguide being at the same potential.

BACKGROUND OF THE INVENTION

Ion sources are used to generate a beam of ions, i.e. of electrically charged atoms or molecules. The various types of ion sources which are suitable for the particular requirements usually make use of a form of gas discharge to ionize neutral atoms or molecules.

The oldest, very simple ion source is the Kanalray ion source or Kanal-ray tube. In this case, a gas discharge in which the ionization takes place by electron or ion impact "burns" at a pressure of $10^{-1}$ to 1 Pa between two electrodes which carry a voltage of a few 1000 volts. This ion source, in which the electrodes are immersed in the plasma is also described as an ion source with capacitive excitation.

Another type of ion generation is achieved by means of the high-frequency ion source. In this case, the ions are generated at about $10^{-2}$ Pa by a high-frequency discharge in the MHz range which burns between two specially shaped electrodes or is generated by an external coil. The ions are drawn out of the plasma by means of a special extraction method and focused (H. Oechsner: Electron cyclotron wave resonances and power absorption effects in electrodeless low pressure H.F. plasmas with superimposed static magnetic field, Plasma Physics, 1974, Volume 16, p. 835 to 841; J. Freisinger, S. Reineck, and H. W. Loeb: The RF-Ion source RIG 10 for intense hydrogen ion beams, Journal de Physique, Colloque C7, Supplement to no. 7, Volume 40, July 1979, p. C7–477 to C7–478; I. Ogawa: Electron cyclotron resonances in a radio-frequency ion source, Nuclear Instruments and Methods 16, 1962, p. 227 to 232).

A disadvantage of many known ion sources with inductive excitation is, however, the fact that they have a substantial HF power loss. This HF power loss occurs as a result of the fact that the HF coil, which is wound round the vessel in which the plasma is located, has to be matched to the HF generator. For this purpose a matching network which matches the generator power to the load power, i.e. to the coil power, is provided between the HF generator and the HF coil (cf. e.g. German Offenlegungsschrift 2,531,812, reference numeral 40 in the figures). This matching consists in transforming the wave impedance of the coil with the plasma as load to the wave impedance of the transmitter line. In this case, a power loss of 20% to 50% of the total power delivered by the HF generator occurs in the matching circuit.

A further disadvantage of the known ion source with inductive excitation consists in the fact that the fitting of additional magnets in the vicinity of the vessel in whch the plasma is located is made more difficult because the HF coil requires a relatively large amount of space and because the magnets heat up in the magnetic field of the HF coil. Such additional magnets are required to keep the plasma away from certain points on the vessel wall or to concentrate the plasma (cf. EP-A-O, 169,744). In addition, the cooling of the coils presents problems because of the circumstance that said coils are, on the one hand, hollow and have cooling water flowing through them and, on the other hand, are at HF potential, as a result of which space-consuming potential reduction paths are required in order to bring the potential from a high value down to a low value. Since the potential reduction is achieved as a rule by lengthening the coil, an increased power loss occurs.

The construction of induction coils as hollow conductors in a current converter system and cooling with a liquid is furthermore known (German Offenlegungsschrift 2,544,275). Such liquid-cooled induction coils are also used, however, in high-frequency induction plasma burners (German Auslegeschrift 2,112,888).

Finally, a device is also known for performing a reaction between a gas and a material in an electromagnetic field, which device comprises a reaction chamber for receiving the gas and the material, an assembled coil with two coil sections linked to each other whose windings are wound in opposite directions, a high-frequency source and equipment for connecting the high-frequency source to the coil (German Offenlegungsschrift 2,245,753). In said device, the two ends of the coil are connected to each other so that they are at the same potential. In addition, one terminal of the high-frequency source is connected to a point on the coil which is located between the two ends of the coil. However, the grounded terminal of the high-frequency source is at a potential other than the ends of the coil. In the case of this device a disadvantage is also the fact that a matching network is necessary.

OBJECTS AND SUMMARY OF THE INVENTION

The object of the invention is therefore based on providing, in an inductively excited ion source in an arrangement which dispenses with a special matching network.

This object is achieved in that the length 1 of the waveguide is essentially n multiplied by $\lambda/2$, $\lambda$ being$=c/f$ and n denoting a non-zero integer, c denoting a constant which is the wave velocity or phase velocity; and f denoting the frequency of the high-frequency generator. The advantage achieved with the invention consists, in particular, in the fact that the power losses of an inductively excited ion source can be substantially reduced. In addition, it is possible to supply and drain the cooling water without difficulty at ground potential.

BRIEF DESCRIPTION OF THE DRAWINGS

An exemplary embodiment of the invention is shown in the drawing and is described in more detail below. Here.

DETAILED DESCRIPTION

Figure 1:
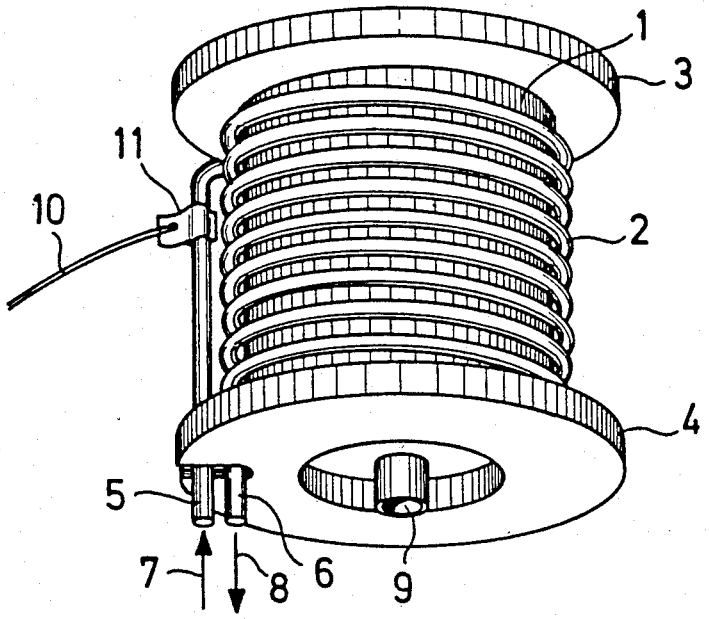
FIG. 1 shows a perspective representation of the external mechanical form of the ion source according to the invention.

FIG. 1 shows an evacuated vessel 1 which is surrounded with an electrically conducting high-frequency coil 2 and which is covered by an upper annular end plate 3. The ends 5, 6 of the high-frequency coil 2 are fed via corresponding holes in the lower end plate 4 to a cooling system which is not shown. This cooling system has the effect that a cooling liquid is introduced through the end 5 of the high-frequency coil 2, which is constructed as a hollow tube, and is removed again through the end 6 of said coil 2. The high-frequency coil 2 consists, for example, of copper tube which in this case, although it is disposed outside the vessel, may, however, also be integrated into the latter or disposed inside the vessel. The inward and outward flow of the cooling liquid is indicated here by the arrows 7 and 8. Water is preferably used as cooling liquid. In the exemplary embodiment the high-frequency coil 2 has nine windings, a diameter of approx. 120 mm and a height of approx. 130 mm. Its length is $\lambda/2$, $\lambda$ being related to the frequency of a high-frequency generator. Coil length is understood to mean the length of the extended coil wire and not, for instance, the coil length. It goes without saying that the high-frequency coil 2 may also have dimensions other than those specified here. In addition, it is not necessarily wound round the vessel 1 but may be located, for example, also on the inside wall of the vessel 1 or integrated into the vesssel wall. At the bottom of the vessel 1 a nozzle 9 is provided through which the gas to be ionized is fed into the vessel 1. The HF power is coupled in via a cable 10 which is connected to a high-frequency generator and which is connected to the coil 2 by means of a clamp 11.

Figure 2:
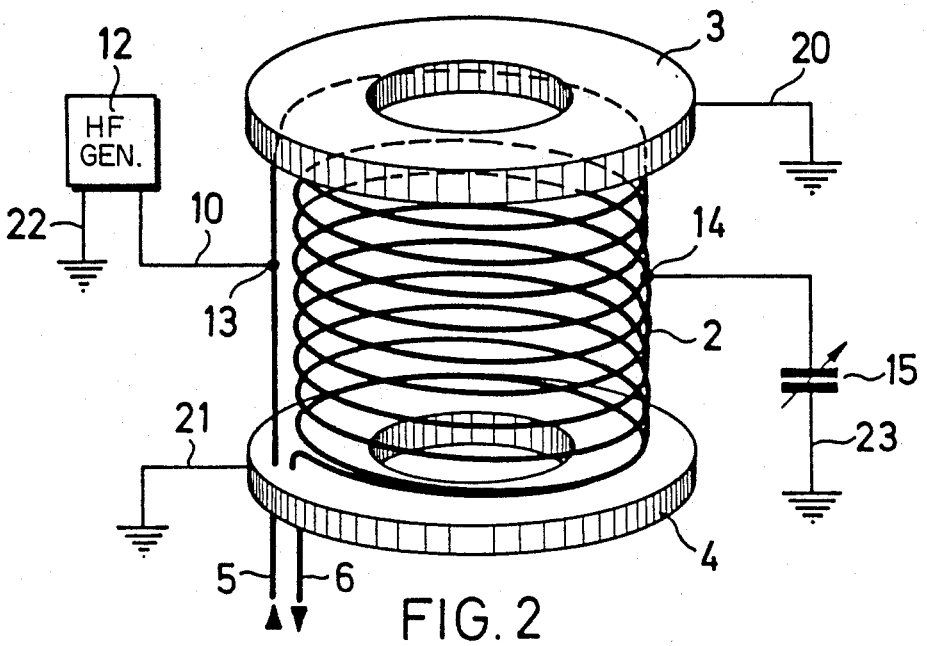
FIG. 2 shows a schematic representation of the electrical circuit arrangement according to the invention.

Apart from the end plates 3, 4, the electrical circuit of the ion source according to the invention is essentially shown in FIG. 2. If the end plates 3, 4 are connected to each other in a highly conductive manner, the ends 5 and 6 of the coil can also be connected to their own plate 3, 4 alone. In FIG. 2 a high-frequency generator 12 is grounded via a conductor 22 and is connected to the high-frequency coil 2 by the cable 10. The electrical connection point of the generator 12 is denoted by 13. At another point on the coil 2 there is a further electrical connection point 14 to which a capacitor 15 with variable capacitance is connected. This capacitor may, however, also be omitted if the resonance frequency of the resonator consisting of the coil 2 and the enclosed plasma is precisely matched to the frequency of the high-frequency generator 12.

As a rule, however, this precise tuning is quite simple to perform so that it is simpler to adjust the oscillatory circuit to resonance by altering the capacitance of the capacitor 15.

The HF generator 12, the lower end plate 4 and the capacitor 15 are connected to ground or chassis via the conductors 21, 22, and 23. Grounding is preferably carried out by means of a short, wide and highly conductive cable which consists e.g. of silver.

Considered in terms of high frequency, the coil has not only an inductance, but also an inherent capacitance. Inductance and capacitance form together the resonance frequency of the coil 2, the inductance and the capacitance being deterined by the so-called distributed inductance and the distributed capacitance. The coil 2 should consequently be regarded as a waveguide on which Lecher-type waves propagate (cf. K. Simonyi: Theoretische Elektrotechnik (Theoretical Electrical Engineering), Berlin 1956, p. 313 to 363, or H.-G. Unger: Elektromagnetische Wellen auf Leitungen (Electromagnetic Waves on Conductors), Heidelberg, 1980). In this connection, the coiling of the coil 2 may be regarded as a subordinate influencing factor compared with its wire length.

The output frequency of the HF generator 12 is set to the resonance frequency of the high-frequency coil 2 which can be influenced by the ions situated in the vessel 1. The total power consumed is consequently consumed in the actual resonance circuit and not across an impedance matching system, i.e. virtually no power loss occurs. In this connection, the actual resonance circuit is understood to mean the combination of exciting coil and plasma, i.e. the exciting coil with the plasma as load. This actual resonance circuit includes, if necessary, also a high-frequency screening enclosure. The representation of such a screening enclosure was dispensed with in the representation in FIG. 2 because the appearance of said enclosure and also its effect on the total resonance circuit is known.

A power matching in the sense that the power of the high-frequency generator 12 is optimally delivered to the coil 2 is discussed below.

This power matching, is, however, possible by means of a suitable choice of the connection point 13 of the conductor 10 to the coil 2. The connection point 13 is so chosen that the quotient of voltage and current at the point 13 is equal to the wave impedance of the conductor 10. If this quotient is continuously measured and it is compared with the known wave impedance, an electrical drive can be controlled by means of a regulating circuit so that the point 13 is always brought to a position in which the abovementioned condition applies. In this manner it is possible to automate the power matching.

In the representation in FIG. 2, the highfrequency generator 12 is by no means short-circuited, as it might appear to be in the case of a consideration in terms of low-frequency. On the contrary, the straight piece of the coil 2 which extends from the connection point 13 to the plate 4 is affected by a distributed inductance and a distributed capacitance which prevents short circuiting in terms of high-frequency.

Instead of setting the frequency of the frequency generator 12 to the natural or resonance frequency of the coil 2, it is also possible to match the resonance frequency of the coil 2 to the specified frequency of the high-frequency generator 12. For this purpose the capacitor 15 is provided which is connected to the coil 2. By adjusting said capacitor 15, which is connected to the symmetry point 14 of the coil 2, the resonance frequency of the coil 2 / capacitor 15 system is altered. The effect of the ions on the resonance frequency of the coil can be compensated for by means of this change.

If an alternating voltage, whose frequency f is equal to the resonance frequency of the coil 2 or of the coil 2 / capacitor 15 system or to a harmonic thereof, is applied to the coil 2 or the coil 2 / capacitor 15 system, the instantaneous currents and voltages are distributed on the coil 2 as integral multiples of half wavelengths. Under these circumstances current antinodes and the voltage nodes always arise at the ends 5, 6 of the coil; i.e. the ends 5, 6 of the coil are at ground potential. The cooling water can therefore be supplied and drained without difficulty at ground potential. At resonance there are always at least two points on the coil at which the ratio of voltage and current is equal to the wave impedance of the conductor 10. If the conductor 10 is connected to such a point 13, the power of the high-frequency generator 12 is coupled in without loss. By displacing this coupling-in point 13 it is possible to compensate for changes in the natural frequency of the coil 2 which result from various plasma densities, i.e. various loads on the coil 2.

As a result of the system according to the invention, the total magnetic field energy which occurs is concentrated in the coil 2 so that its magnetic field very effectively holds the plasma together and compresses it. Of course, the coil can also be constructed differently, e.g. in meandor form in order to generate another field configuration, e.g. a "cusp" field or multipolar field, as is shown in FIG. 2 of EP-A-O, 169,744.

Figure 3:
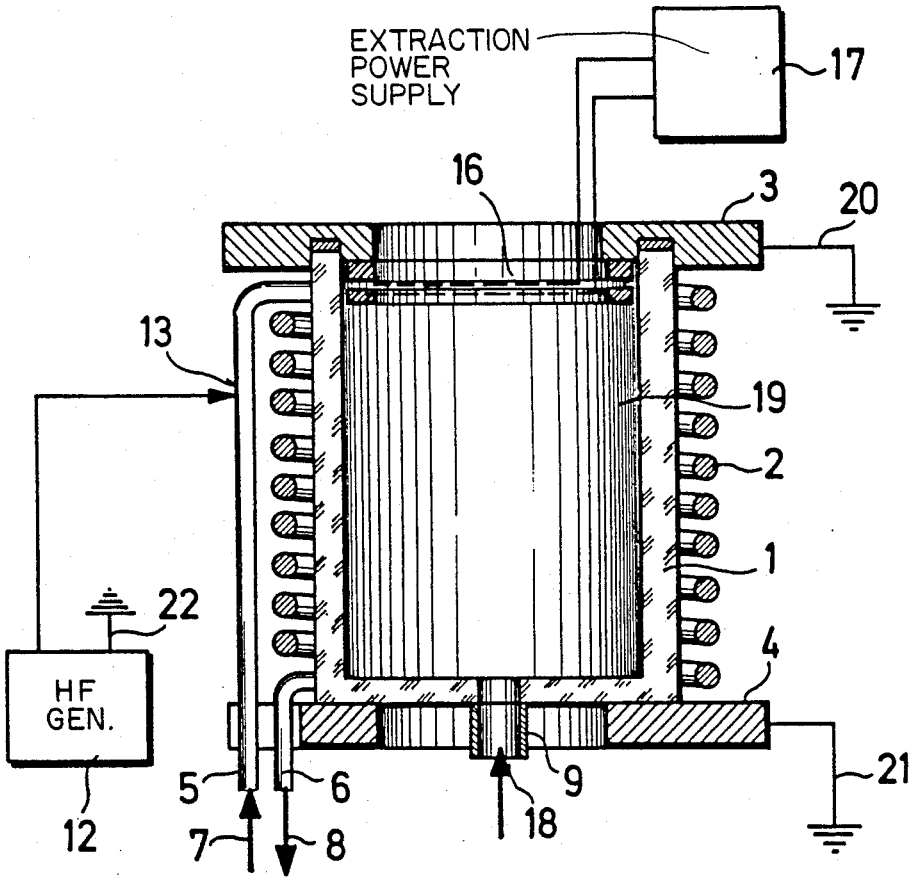
FIG. 3 shows a sectional representation through the ion source according to the invention with the associated electrical terminals.

FIG. 3 shows the system according to the invention once again in section. The vessel 1, which is constructed cylindrically and consists of a chemically inert material, is surrounded by the coil 2 and has at its upper end an extraction grid system 16 which is connected to an extraction power supply 17. The inlet nozzle 9 with its gas feed channel 18 is provided at the lower end of the vessel 1. If a pressure between about $2\times10^{-2}$ Pa and 50 Pa is established in the discharge space 19 of the vessel 1, a discharge can be ignited by switching on the high-frequency generator 12. The ions produced in this process are sucked off through the extraction grid system 16 if a suitable voltage of the extraction power supply 17 is applied to said grid system 16. In contrast to the annular end plates 3, 4 which are grounded via the conductors 20, 21 or in contrast to the high-frequency generator 12 which is grounded via the conductor 22, the extraction grid system is not at ground potential.

Although resonance phenomena play an important part in the invention, it nevertheless differs substantially from other circuits for inductively coupled low-pressure plasma which also employ resonance. In the known resonance inductor already referred to above, it is necessary to undertake matching by means of capacitances and inductances. But in addition, if the coil or the inductor is fed via an asymmetrical conductor, for example a coaxial cable, it is necessary to balance said cable and match it to the inductor impedance. In the present invention, matching networks and impedance transformations are unnecessary. Neither an impedance transformation by means of a HF transformer nor via a $\pi$-transformation or a T-transformation is necessary.

Figure 4:
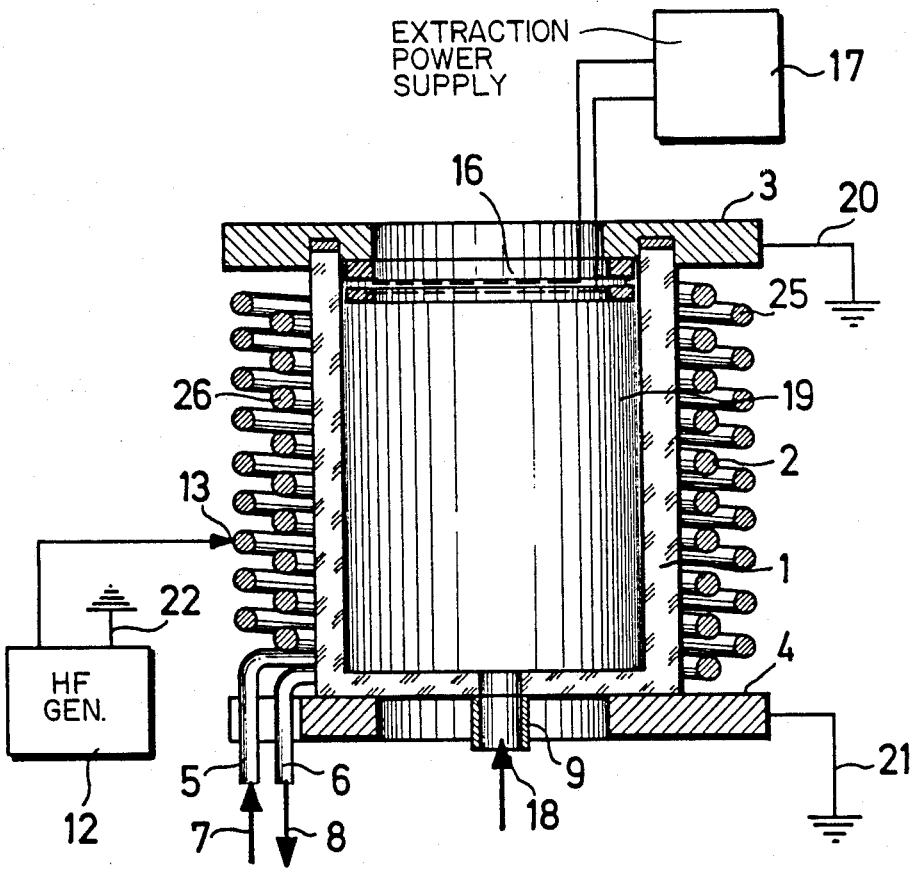
FIG. 4 shows a sectional representation through a variant of the ion source according to the invention.

FIG. 4 shows a variant of the ion source shown in FIG. 3. In this embodiment, the fundamental resonance frequency of the coil 2 of originally approx. 50 MHz is reduced to about half its original value to approx. 25 MHz by doubling its length. In this case, the doubling of the coil length is achieved by a second coil layer which is denoted by 25. The winding sense of the two coil layers 25, 26 may run in opposite directions, as a result of which particularly advantageous effects are achieved.

The efficiency of the ion source is improved by a small separation of resonance and excitation frequency. In addition, the inductance increases with the winding number of the coil, which leads to an improvement in the oscillatory circuit quality.

With the double-layer winding of the coil 2 it is possible to achieve ignition without a pressure wave, i.e. a purely electrical ignition is possible.

Figure 5:
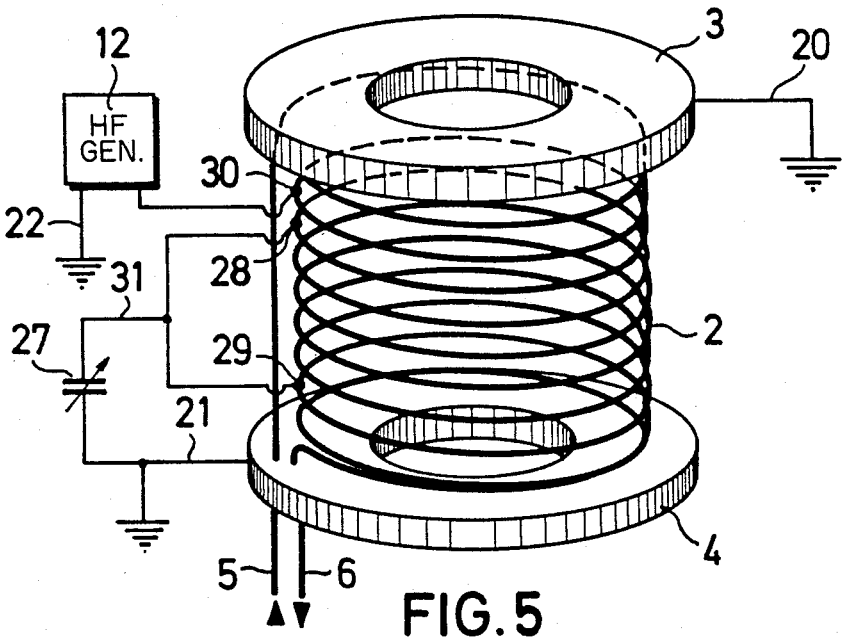
FIG. 5 shows a special connection of a variable capacitor to a coil of the ion source according to the invention.

FIG. 5 shows a variant of the connection of a capacitor 27 shown in FIG. 2 to the coil. In this case, the capacitor is connected at two points 28, 29 to the coil 2, while the oscillator 12 is applied to the "50 Ohm point" 30 of the coil 2. As a result of this connection, the HF ion source is tuned at low voltage level. Although the effect of the capacitor 27 on the tuning is less in this case and a certain distortion of the current and voltage distribution occurs, the capacitor conductor 31 can be of longer construction because of the lower voltage. The advantage achieved as a result consists, in particular, in the fact that the capacitor no longer has to be directly situated on the ion source but can be disposed at a certain distance from the latter without substantial power losses occurring in this case due to leakage capacitances which are at high voltage.

I claim:

1. Inductively excited ion source with a vessel for receiving plasma to be ionized, the plasma to be ionized being surrounded by a waveguide which is connected to a high-frequency generator, and the two ends of the waveguide being at the same potential, characterized in that the length 1 of the waveguide (2) is essentially equal to n multiplied by c and divided by 2f, n denoting a non-zero integer, c denoting a constant which is the phase velocity of an electrical wave, and f denoting the frequency of the high-frequency generator (12), whereby said high-frequency generator (12) is tuned to the natural frequency of the system consisting of the waveguide (2) and the plasma to be ionized or to a harmonic frequency of said natural frequency.

2. Inductively excited ion source according to claim 1, characterized i that the waveguide includes a doublelayer winding (25, 26) of a coil (2) such that the coil length is doubled.

3. Inductively excited ion source according to claim 1, characterized in that the potential which the ends (5, 6) of the wave guide (2) and one terminal (22) of the high-frequency generator (2) are at ground potential.

4. Inductively excited ion source according to claim 2, characterized in that one winding layer (25) of the coil is wound in one direction and the other winding layer is wound opposite said one direction.

5. Inductively excited ion source according to claim 1, characterized in that the tuning of the natural frequency of the system, consisting of the waveguide (2) and the plasma to be ionized, is carried out by means of a variable capacitor (15).

6. Inductively excited ion source according to claim 5, characterized in that the capacitor (15) is connected at an electrical symmetry point (14) of the waveguide (2), the electrical symmetry point is opposite a point (13) for feeding the high-frequency power of the high-frequency generator (12) into the waveguide (2) chosen so that the quotient of voltage and current strength on it in the particular operating condition of the ion source is equal to the wave impedance of a conductor (10) between the waveguide and the high-frequency generator.

7. Inductively excited ion source according to claim 5, characterized in that one terminal of the capacitor (15) is on a coil (2) defning the waveguide and the other terminal of said capacitor (15) is at ground.

8. Inductively excited ion source according to claim 1, characterized in that the frequency of high-frequency generator (12) corresponds to the frequency of a harmonic of a coil (2) defining the waveguide.

9. Inductively excited ion source according to claim 1, characterized in that the waveguide is a coil (2) constructed as a hollow tube through which a coolant flows.

10. Inductively excited ion source according to claim 9, characterized in that the coolant is water.

11. Inductively excited ion source according to claim 1, characterized in that a point (13) for feeding the high-frequency power of the high-frequency generator (12) into the wave guide (2) is chosen so that the quotient of voltage and current strength on it in the particular operating condition of the ion source is equal to the wave impedance of a conductor (10) between the waveguide and the high-frequency generator.

12. Inductively excited ion source according to claim 11, characterized in that the point (13) for feeding in the high-frequency power is adjusted automatically.

13. Inductively excited ion source according to claim 1, characterized in that the vessel (1) has the form of a hollow cylinder and is covered with an upper and a lower end plate (3 or 4 respectively), the upper end plate (3) being provided with an extraction grid (16) and the lower end plate (4) being provided with an open nozzle (9) for the plasma feed, and ends (5, 6) of the waveguide (2) being grounded via an end plate (3 or 4 respectively).

14. Inductively excited ion source according to claim 1, characterized in that the waveguide (2) also has a direct current flowing through it which generates a magnetic field which guides the ions.

15. Inductively excited ion source according to claim 1, characterized in that a variable capacitor (27) is provided which has one terminal at ground potential and has its other terminal connected to two different points (28, 29) of a coil (2) defining the waveguide.

* * * * *